US006666166B2

(12) United States Patent
Kramer et al.

(10) Patent No.: US 6,666,166 B2
(45) Date of Patent: Dec. 23, 2003

(54) SPRAYBOOTH SCRUBBER NOISE REFLECTOR

(75) Inventors: Jason L. Kramer, Northville, MI (US); James L. Pakkala, Livonia, MI (US); Joseph M. Klobucar, Detroit, MI (US); Gregory M. Still, Plymouth, MI (US)

(73) Assignee: Dürr Industries, Inc., Plymouth, MI (US)

( * ) Notice: Subject to any disclaimer, the term of this patent is extended or adjusted under 35 U.S.C. 154(b) by 344 days.

(21) Appl. No.: 09/934,941

(22) Filed: Aug. 22, 2001

(65) Prior Publication Data

US 2002/0000478 A1 Jan. 3, 2002

Related U.S. Application Data

(60) Provisional application No. 60/204,409, filed on May 16, 2000.

(51) Int. Cl.[7] ..... B05B 15/12

(52) U.S. Cl. ..... 118/326; 118/309; 454/54; 96/323; 55/DIG. 46

(58) Field of Search ..... 118/326, 308, 118/309; 55/DIG. 46; 96/322, 323; 454/49, 50, 53, 54

(56) References Cited

U.S. PATENT DOCUMENTS

| | | | | |
|---|---|---|---|---|
| 5,020,470 A | | 6/1991 | West et al. | 118/326 |
| 5,100,442 A | | 3/1992 | Gore et al. | 55/240 |
| 5,133,316 A | | 7/1992 | Kasai et al. | 123/198 |
| 5,473,122 A | | 12/1995 | Kodiyalam et al. | 181/207 |
| 5,846,303 A | * | 12/1998 | Milojevic | 96/323 |
| 6,093,250 A | * | 7/2000 | Salazar et al. | 118/326 |

* cited by examiner

*Primary Examiner*—Richard Crispino
*Assistant Examiner*—Yewebdar T Tadesse
(74) *Attorney, Agent, or Firm*—Howard & Howard

(57) ABSTRACT

A spray application system includes an enclosed spraybooth area in which airborne particles are generated and a scrubber system is located below the enclosed spraybooth area. The scrubber system includes an inlet receiving water and air from the spraybooth area along with airborne particles. The scrubber system transfers the airborne particles to the water for cleaning the air. A generally downwardly opening noise reflector is located directly over the inlet of the scrubber system and is configured to reflect sound generated by the scrubber system back into the inlet of the scrubber system. The reflector is spaced from the inlet of the scrubber system a distance equal to approximately the width of the inlet.

25 Claims, 2 Drawing Sheets

SPRAYBOOTH SCRUBBER NOISE REFLECTOR

This application claims the benefit of provisional application 60/204,409 filed May 16, 2000.

This invention relates to an apparatus for reducing the sound or noise generated in a chamber, such as a paint spraybooth, having airbourne liquid or solid particulates and a scrubber system located below the chamber which receives water and removes the particulates from the chamber. More specifically, the present invention relates to a noise reflector and damper for spraybooths which reflects the noise into the throat of the scrubber and reduces noise in the booth.

This application claims priority to PCT Patent Application No. PCT/US01/15016 filed on Jul. 11, 2001.

BACKGROUND OF THE INVENTION

A typical spraybooth, such as the paint spraybooths used for painting of vehicle bodies by the automotive industry, comprises three basic components or sections. First, there is a painting area or section wherein the article to be painted is located or conveyed through the painting area, which generally includes paint or spray application equipment, such as robotic paint spray equipment, and one or more operators. Second, there is generally an air supply plenum located above the painting area which provides a continuous downdraft of filtered, temperature controlled air to the painting area. The air supply plenum is generally essential for maintaining paint finish quality. The downdraft pulls coating or paint overspray down, away from the article being painted and prevents the airbourne particulates from settling on the painted article and spoiling the finish. The air supply plenum also keeps the overspray away from the painting apparatus and operators. Finally, there is a scrubber system located below the painting area. In a typical paint spraybooth such as used by the automotive industry, the floor of the painting area is defined by a grate or open metal grid which is located several feet above the flood sheet and the scrubber assemblies. Typically, water or water containing various additives is flooded onto the flood sheet and received in the inlet throat of the scrubber system. The air supply and the water supply are balanced to provide either a neutral or slightly positive air pressure relative to the environment to prevent airborne dirt from being drawn into the booth. The scrubber system intermixes the air having airbourne solid or liquid particulates and the water from the flood sheet and transfers the particulates to the water, cleaning the air for recirculation or venting to the atmosphere. Upwardly opening pan-shaped shrouds have also been used on the grate above the throat of the scrubbers which may be flooded with water and catch larger articles from falling into the scrubber throat. In a typical application, the shroud has a width substantially greater than the width of the scrubber inlet and is located several feet above the inlet of the scrubber. In a typical automotive application, the grate is located about six feet above the flood sheet and the width of the shroud is more than twice the width of the scrubber inlet. Although a shroud of this type may provide some sound attenuation, particularly where the pan-shaped shroud is flooded with water, the noise reduction in the painting area resulting from the shroud is minimal.

It is well known that the noise generated by scrubber systems in the painting area of a conventional paint spraybooth of the type described above is significant and unacceptable in some applications. Even where the paint is applied to a vehicle body by robotic controlled electrostatic spray apparatus, an operator must still monitor the equipment inside the booth. There is, therefore, a longstanding need to reduce the sound generated in the painting area by the scrubber system. Various attempts have been made to reduce the noise generated in the painting area; however, the proposed solutions to this problem generally require additional costs and often do not adequately solve the problem. For example, flow through systems, wherein the water is not thoroughly intermixed with the air in the scrubber system requires a complete redesign of the scrubber system and substantial additional expense, including discreet spaced scrubber sections and a pool of water located below the scrubber tubes where the mixing takes place. Such flow through systems are also less efficient in removing the paint particulates from the air than a scrubber system wherein turbulent air and water flow is generated in the scrubber and the thoroughly mixed air and water is projected by the scrubber against an opposed separator wall. The need therefore remains to reduce the noise generated in the painting booth without reducing the efficiency of the scrubber system.

SUMMARY OF THE INVENTION

As set forth above, this invention relates to improvements in spray application systems, including paint spray application systems having an enclosed spraybooth area wherein airborne paint particles are generated and a scrubber system located below the enclosed spraybooth area to scrub the airborne particles from the spraybooth. The scrubber includes an inlet receiving water and air with airborne particles from the enclosed spraybooth area, which transfers the airbourne particles to the water, thereby cleaning the air. More specifically, this invention relates to a sound abatement device for paint spray application systems such as used by the automotive industry to paint vehicle bodies. The working floor of the spraybooth is defined by an open grate or open metal grid which is spaced several feet above a flood sheet formed by the water. The scrubber system inlet is generally level with the flood sheet. Air containing liquid or solid paint particulate is forced through the grate by the down draft created by the airflow through the plenum to the scrubber system inlet, or inlets where discreet scrubber systems are used, and through the scrubber system. Water is continuously circulated onto the flood sheet and received through the scrubber system inlet. The scrubber system is designed to transfer the airbourne particulates to the water, cleaning the air.

All scrubber systems, however, generate noise which is generated through the scrubber system into the work area above the floor. The improvement disclosed herein includes a noise reflector located directly over the scrubber system inlet which is preferably spaced from the inlet a distance equal to approximately the width of the inlet configured to reflect sound generated by or through the scrubber system back into the scrubber system inlet, thereby significantly reducing the sound generated by the scrubber system in the enclosed spraybooth work area. In one preferred embodiment, the noise reflector opens downwardly toward the scrubber system inlet reflecting the sound generated by the scrubber system into the scrubber system inlet. In another preferred embodiment, the reflector is generally arcuate opening toward the scrubber system inlet. In the most preferred embodiment, the reflector is generally semicircular, most preferably where the arc is equal to approximately two times the width of the scrubber system inlet. The noise reflector in this embodiment may be curved or faceted to focus the sound back into the scrubber system inlet.

In the testing of this embodiment of the noise reflector, it has been found that the distance between the reflector and the scrubber system inlet is important. If the noise reflector is located too close to the scrubber system inlet, it will interfere with the airflow pattern into the scrubber system inlet. However, if it is located too far from the scrubber system inlet, the efficiency of the noise reflector will be reduced or eliminated. Thus, in the most preferred embodiment, the noise reflector is located directly over the scrubber system inlet, but spaced from the inlet a distance equal to approximately the width of the inlet. This spacing provides good sound attenuation without interfering with the airflow pattern into the inlet of the scrubber system.

Similarly, testing of this invention indicated that the wider the noise reflector is, the more effective the sound attenuation. However, a noise reflector having a width substantially greater than the width of the scrubber system inlet also interferes with the airflow pattern into the scrubber system inlet. Thus, in the most preferred embodiment, the width of the noise reflector is generally equal to the width of the scrubber system inlet. Thus, a noise reflector spaced from the scrubber system inlet a distance equal to approximately the width of the scrubber system inlet and having a width approximately equal to the width of the scrubber system inlet yielded the good results while avoiding interference with the airflow pattern into the scrubber system inlet.

A further improvement in the sound attenuation provided by the noise reflector of this invention may be provided by using a sound attenuating or damping material for the noise reflector, wherein some of the noise generated by the scrubber system is absorbed by the noise reflector. In one preferred embodiment, the noise reflector is formed of a metal sheet and a laminated polymeric sheet which damps, absorbs or deadens the sound generated by the scrubber system. In the most preferred embodiment, the noise reflector is formed of a laminate having outside metallic sheets and a polymeric sheet sandwiched and laminated to the metal sheets, wherein the metallic and polymeric sheets have approximately the same thickness. The polymeric sheet may be formed of any suitable viscoelastic material, such as rubber, synthetic rubber or a polymer providing acoustical damping properties to the noise reflector by absorbing vibrational energy in the reflector. Such sound damping laminated panels have been used for damping structure-bourne sound as disclosed in U.S. Pat. No. 5,473,122 and for engine cylinder head covers as disclosed in U.S. Pat. No. 5,133,316. However, it is believed that such sound deadening laminates have not been used as a reflector as disclosed herein.

Other advantages and meritorious features of this invention will be more fully understood from the following description of the preferred embodiments, the appended claims and the drawings, a brief description of which follows.

DESCRIPTION OF THE PREFERRED EMBODIMENTS

Figure 1:
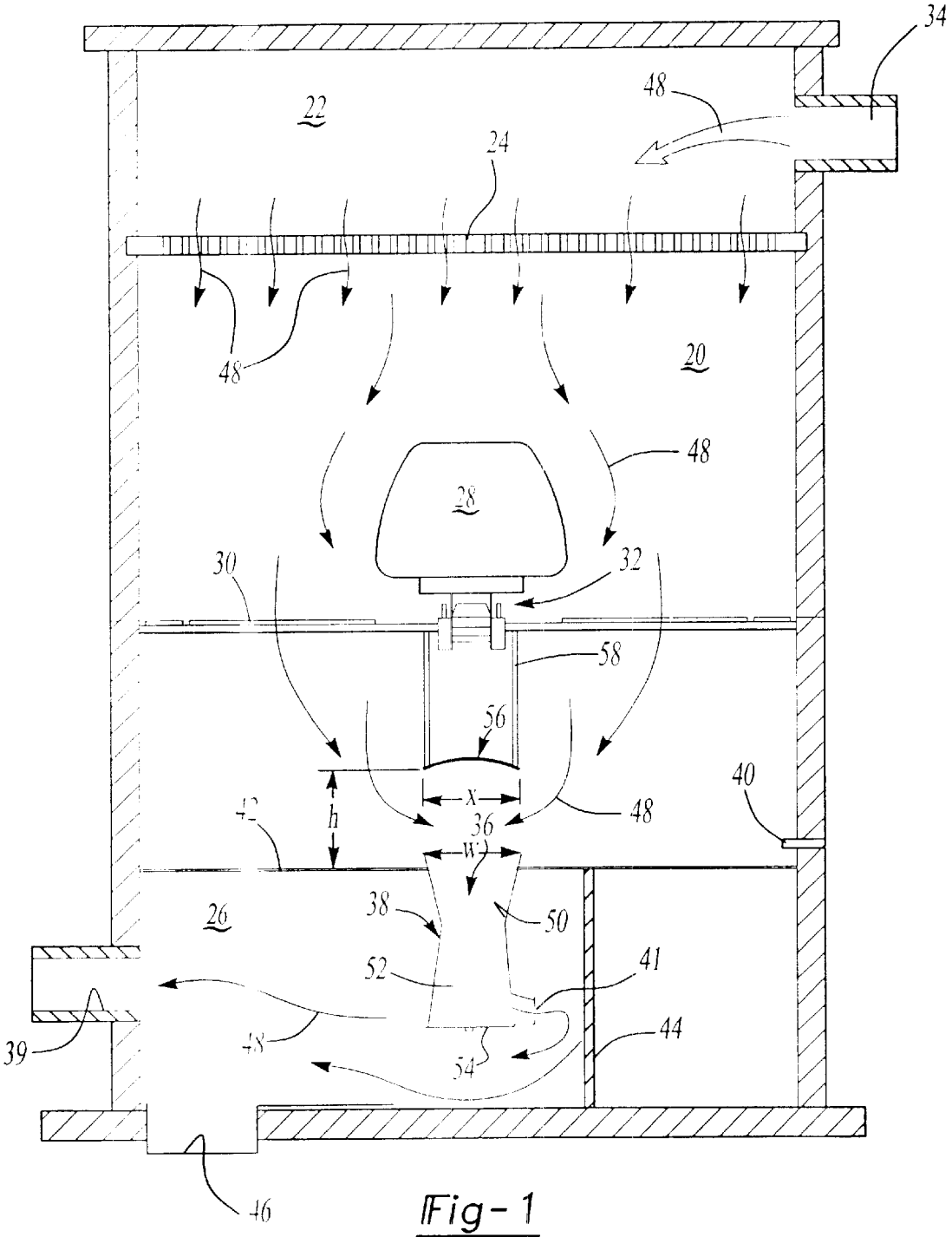
FIG. 1 is a schematic side elevation of one embodiment of the spray application system and reflector of this invention.

FIG. 1 illustrates a generally conventional paint spray application booth having the improved sound attenuation system of this invention. The disclosed paint application booth includes a paint spraying section 20, an air supply section or plenum 22 located above the paint spraying section 20 and separated from the paint spraying section by an apertured wall 26, and a scrubber section 26. The painting section 20 includes paint spray apparatus (not shown) for applying paint to an article, such as vehicle body 28. The paint spraying section 20 includes a work floor 30 generally in the form of a metal grate or open metal grid and the article to be painted 28 is generally conveyed through the paint spraying section 20 by a conveyer 32.

Air is circulated generally under pressure through the inlet 34 of the air plenum 22 where it circulates through the apertured wall 24, around the article to be painted, through the apertured work floor 30 into the inlet 36 of the scrubber 38. As set forth above, the air supply plenum 22 provides a continuous downdraft of filtered, temperature-controlled air to the painting area which is important for maintaining fresh air quality. The downdraft pulls the paint overspray downwardly away from the article 28 being painted and prevents the paint particles and other airborne dirt from settling on the painted surface, which defects the paint finish. The air circulation also keeps the paint overspray away from the painting equipment and operators located in the paint spraying section 20. The circulating air is then received in the inlet 36 of the scrubber 38 and circulated through the scrubber section 26 to the outlet 39. Because the air is cleaned by the scrubber 38, the outlet 39 may be connected to atmosphere or recirculated through the system. Water is continuously pumped from a water inlet 40 onto the flood sheet 42 providing an expansive contact surface with the airborne particulates. The water then flows into the inlet 36 of the scrubber 38 and the water and air mixture is propelled by the scrubber 38 through scrubber outlet 41 against an impact wall 44. The water containing the airbourne paint particles is then received in trough 46 and is filtered to remove the particulate matter for disposal. The water is typically treated with chemicals that flock and detacify the paint particles to prevent a buildup of uncured paint upon the scrubber 38 and other related apparatus. The airflow through the paint spraybooth is indicated in FIG. 1 by arrows 48.

As set forth above, there are numerous types of scrubbers on the market, all of which generate noise including the straight through scrubber systems, wherein the mixing of the air and water does not occur until the water and air are mixed in an impact pool located below the scrubber system. However, such straight through scrubber systems are not as efficient as the venturi scrubber system shown in FIG. 1 and more fully disclosed in U.S. Pat. No. 5,100,442 assigned to the assignee of the present application. In this embodiment of the scrubber system, the inlet 36 is inwardly tapered to a throat 50, an outwardly tapered lower section 52 and a transverse bottom wall 54, which bends the water and air through ninety degrees promoting turbulent flow and thoroughly mixing of the air and water. The thoroughly mixed air and water is then propelled out of the reduced diameter outlet 41 against the transverse impact wall 44, assuring complete transfer of the paint particles to the water. However, as set forth above, the noise generated by the scrubber 38 is reflected through the inlet 36 to the work area 20 where the operators are located. Further, as described above, various attempts have been made to attenuate or reduce the noise generated in the paint spraying section 20, but such designs are complex, expensive and do not sufficiently reduce the noise for many applications.

Having described a typical paint spraybooth, such as used by the automotive industry to paint vehicle bodies, the sound attenuation system for such an application will now be described. It will be understood, however, that the sound attenuation system of this invention may also be utilized for other paint and spray application systems, wherein liquid or solid airbourne particles are generated requiring the use of a scrubber system located below the work area of the spraybooth which generates noise in the work area. Further, as set forth above, the sound attenuation system of this invention may be utilized with any scrubber system.

As shown in FIG. 1, the paint application booth includes a noise reflector 56 which, in the preferred embodiment, is a noise reflector and damper as described below. The noise reflector 56 is suspended directly above the inlet 36 of the scrubber system by hangers 58 secured to the open grid floor 30 of the paint spraying section 20. The hangers 58 may be metal rods having a hook-shaped end portions (not shown) received in openings in the noise reflector or steel plates having a width for example of two inches and a thickness of ¼ inch, wherein the noise reflector has transverse pins (not shown) received in openings in the hangers. In either embodiment, the noise reflector 56 may be easily removed for cleaning. However, the efficiency of the noise reflector is not dependent upon having a clean surface and the reflective surface opposite the inlet 36 of the scrubber 38 will not accumulate significant quantities of paint.

The embodiment of the noise reflector 56 shown in FIG. 1 is arcuate or more specifically generally semicircular and coaxially aligned with the inlet 36 of the scrubber system. Therefore, the noise reflector functions as a "parabolic mirror" reflecting the noise generated by the scrubber system directly back into the inlet 36, thereby significantly reducing the noise generated by the scrubber in the paint spraying section 20. As used herein, "semicircular" or "generally semicircular" refers to a portion of a circle which includes a continuous curve or a faceted curve comprised of a plurality of short, flat sections defining a semicircular configuration. The arcuate surface of the reflector may also be parabolic.

As set forth above, the closer the noise reflector 56 is located relative to the inlet 36 of the scrubber 38, the greater the efficiency of the noise reflector in reflecting noise into the inlet 36 of the scrubber system 38. Similarly, the wider the reflector is, the greater its efficiency. However, if the reflector is placed too low, that is, too close to the inlet 36 of the scrubber, the reflector will interfere with the airflow pattern into the scrubber opening, reducing the efficiency of the scrubber. Similarly, if the scrubber is too wide, the noise reflector will interfere with the airflow to the scrubber inlet 36. However, using a noise reflector having an arcuate surface facing the airflow does improve the efficiency of the airflow.

Thus, it is necessary to balance the efficiency of the noise reflector 56 and the airflow 48 through the paint spraybooth. Experimentation with various locations of the reflector 56 relative to the scrubber inlet 36 and various widths of the reflector 56 indicates that a reflector 56 located above the scrubber inlet 36 a distance "h" equal to approximately the width "w" of the scrubber inlet results in the greatest efficiency for the reflector without interference with the airflow 48 to the scrubber inlet 36. Placing the noise reflector 56 at this location, it was found that a reflector having a width "x" approximately equal to the scrubber inlet width "w" also does not interfere with the airflow 48 to the inlet 36 and results in good noise reflection. Thus, this configuration is the most preferred configuration for the reflector 56 as discussed further below in relation to the graph of FIG. 3.

Figure 2:
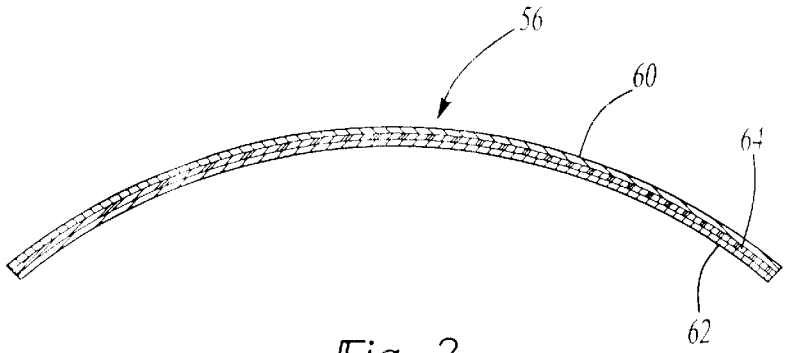
FIG. 2 is a side cross-sectional view of the noise reflector.

As set forth above, the noise reflector 56 may also be a noise damper. Thus, in the most preferred embodiment, the noise reflector is constructed to also provide damping of the noise generated by the scrubber 38. Noise damping material is known in the art as set forth above for damping structure-bourne sound, but in the present invention, the noise reflector is utilized to damp noise generated from a nonassociated element, namely the scrubber system 38. In the embodiment of the noise reflector and damper 56 shown in FIG. 2, the noise reflector is formed of a sandwich-like construction which includes outer layers of metal, preferably steel, and an inner layer 64 of a sound damping material which is bonded to the steel sheets, such as available from Paragon Manufacturing, Inc. for damping structure-bourne sound and described in the above-referenced U.S. patents. Such panels are rated to dampen structure-bourne sound by between 10 and 20 dB. As will now be understood, the use of a sound damper coaxially aligned with the inlet 36 of the scrubber 38 increases the potential configurations of the noise reflector and damper system. In certain applications where a sound damping material is used, the noise reflector and damper 56 may be flat. The preferred damping layer 64 is referred to as a "viscoelastic" material, such as an aramid fiber material and the metal layers 62 and 64 may also be formed of an aluminum-graphite material, wherein the viscoelastic material 64 is bonded to the metallic layers 60 and 62. In the preferred embodiments of the noise reflector and damper 56, the damper material includes at least one metallic layer and a damping layer 64, such as a viscoelastic material. It should be understood, however, that the damping layer 64 can be sandwiched between the metallic layers 60, 62.

Figure 3:
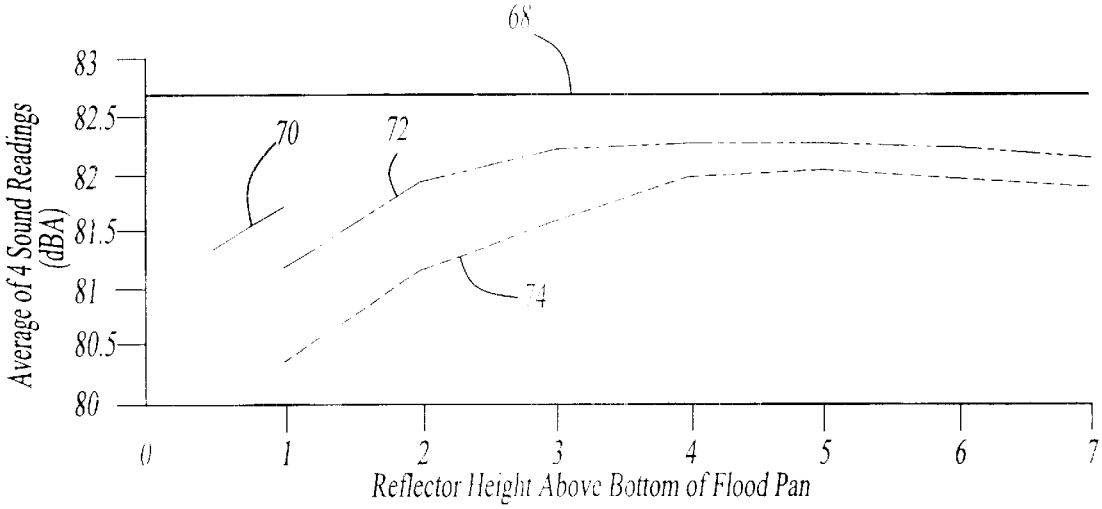
FIG. 3 is a graphical illustration of the improvement provided by the spray application system and reflector of this invention.

Finally, FIG. 3 is a graph of the testing conducted on noise reflectors in a paint spraybooth of the type shown in FIG. 1 using a generally semicircular steel noise reflector having a diameter equal to approximately twice the width w of the inlet opening or throat of the scrubber which was found by earlier experimentation to be a preferred curvature for the noise reflector. Referring to FIG. 3, line 68 is an average of four sound readings in decibels in a paint spraying section 20 as shown in FIG. 1 with a scrubber of the type disclosed and more specifically described in U.S. Pat. No. 5,100,442 assigned to the assignee of this application. Line 70 is an average of four sound readings in decibels in the paint spraying section 20 using a noise reflector having a width of 12 inches. Line 72 is an average of four sound readings in decibels using a noise reflector having a width of 18 inches and line 74 is an average of four sound readings using a noise reflector having a width of 24 inches. As can be observed from this data, generally the wider the noise reflector 56, the greater the efficiency of the reflector in reducing noise in the paint spraying section 20. However, interference with the flow of air to the inlet 36 of the scrubber 38 was observed with reflectors having a width of 18 inches and 24 inches, wherein the reflector was spaced from the inlet 36 a distance of one foot. Interference was also found where the reflector was 12 inches in width at a height of six inches above the inlet 36. The scrubber system 38 used in these tests had an inlet opening of 19 inches in width, which is dimension w in FIG. 1.

Thus, taking into account the criticality of unrestricted airflow through the paint spraybooth 20 to the scrubber inlet 36 for efficient operation of the scrubber 38, it was found most advantageous that the reflector 56 have a width x approximately equal to the width w of the inlet opening 36 and that the reflector 56 be spaced above the inlet opening 36 a distance equal to approximately the width w of the inlet opening. The length of the noise reflector 56 will depend upon the length of the scrubber inlet 36, wherein the preferred embodiment includes a noise reflector 56 having a length approximately equal to the length of the scrubber inlet 36 measured perpendicular to FIG. 1. Where the scrubber system 38 includes a plurality of spaced inlets 36, for example, the reflectors 56 should also be discreet, each having a length approximately equal to the length of the scrubber openings, each reflector 56 is positioned above. In many applications, however, where the scrubber 38 extends substantially the full length of the paint spraybooth, the noise reflector 56 should also extend the full length of the booth. As used herein, the term "approximately equal," includes plus or minus 50 percent, or more preferably plus or minus 30 percent.

Having described the preferred embodiments of the spraybooth scrubber noise reflector and damping system of this invention, it will be understood by those skilled in the art that various modifications may be made to the disclosed embodiments within the purview of the appended claims. As described above, the sound attenuation system disclosed herein may be used with any scrubber system and may be used with other spray application systems having a scrubber system.

What is claimed is:

1. A spray application system including an enclosed spraybooth area in which airborne particles are generated and a scrubber system located below said enclosed spraybooth area having an inlet receiving water and air from said spraybooth area including said airbourne particles and said scrubber system transferring said airboume particles to said water, cleaning said air, the improvement comprising:

a generally downwardly opening noise reflector located directly over said inlet of said scrubber system configured to reflect sound generated by said scrubber system back into said inlet of said scrubber system and being spaced from said inlet of said scrubber system a distance equal to approximately the width of said inlet.

2. The spray application system defined in claim 1, wherein said noise reflector is generally arcuate opening toward said inlet of said scrubber system.

3. The spray application system defined in claim 2, wherein said noise reflector is generally semicircular.

4. The spray application system defined in claim 3, wherein said generally semicircular noise reflector includes a diameter generally equal to twice said width of said inlet of said scrubber system.

5. The spray application system defined in claim 1, wherein said noise reflector includes a width generally equal to said width of said inlet of said scrubber system.

6. The spray application system defined in claim 1, wherein said spray application system includes a floor spaced above said inlet of said scrubber system and said noise reflector is suspended from said floor.

7. The spray application system as defined in claim 1, wherein said noise reflector is formed of at least one metal sheet and a polymeric sheet affixed to said at least one metal sheet further reducing the noise generated in said enclosed spraybooth area by absorbing noise generated by said scrubber system.

8. The spray application system defined in claim 7, wherein said noise reflector is formed of a laminate comprising outside metal sheets and a polymeric inner sheet sandwiched between said metal sheets.

9. The spray application system defined in claim 8, wherein said metal and polymeric sheets have approximately the same thickness.

10. The spray application system defined in claim 8, wherein said polymeric sheet comprises a polymer capable of absorbing vibrational energy derived from noise emanating from said scrubber system.

11. A paint application system including an enclosed paint spray area in which airbourne paint particles are generated and a scrubber system located below said enclosed paint spray area having an inlet receiving water and air from said enclosed paint spray area including said airbourne paint particles and said scrubber system transferring said paint particles to said water, cleaning said air, the improvement comprising:

a noise reflector located directly over said inlet of said scrubber system configured to reflect sound generated by said scrubber system back into said scrubber system inlet and being spaced from said inlet of said scrubber system a distance equal to approximately the width of said inlet of said scrubber system and said noise reflector having a width approximately equal to said width of said inlet of said scrubber system.

12. The paint spray application system defined in claim 11, wherein said noise reflector is generally arcuate opening towards said inlet of said scrubber system thereby reflecting sound generated by said scrubber system back into said inlet of said scrubber system.

13. The paint spray application system defined in claim 12, wherein said noise reflector is generally semicircular.

14. The paint spray application system defined in claim 13, wherein the diameter of said semicircular noise reflector is generally equal to twice said width of said scrubber system inlet.

15. The paint spray application system defined in claim 11, further including a floor spaced above said scrubber system inlet and said noise reflector is suspended from said floor.

16. The paint spray application system defined in claim 11, wherein said noise reflector is formed of a metallic sheet and a laminated polymeric sheet damping the noise generated by said scrubber system into said paint spray area through said scrubber system inlet.

17. The paint spray application system defined in claim 11, wherein said noise reflector is formed of a laminate including thin metallic sheets and a polymeric damping layer of viscoelastic material sandwiched between and laminated to said metallic sheets.

18. A paint spray application system including an enclosed paint spray area in which airboume paint particles are generated and a scrubber system located below said enclosed paint spray area having an inlet receiving water and air from said enclosed paint spray area including said airbourne paint particles, and said scrubber system transferring said paint particles to said water, cleaning said air, the improvement comprising:

a sound damping reflector located directly over said scrubber system inlet reflecting noise generated by said scrubber system through said inlet away from said paint spray area and being formed of a metallic sheet and a sound damping layer.

19. The paint spray application system defined in claim 18, wherein said sound damping reflector is generally arcuate opening downwardly towards said scrubber system inlet reflecting noise generated by said scrubber system towards said scrubber system inlet.

20. The paint spray application system defined in claim 18, wherein said sound damping reflector is spaced above said scrubber system inlet a distance equal to approximately the width of said scrubber system inlet.

21. The paint spray application system defined in claim 20, wherein the diameter of said generally arcuate sound damping reflector is generally equal to twice the width of said scrubber inlet system.

22. The paint spray application system defined in claim 11, wherein said sound damping reflector is formed of metal sheets having a damping layer sandwiched between and bonded to said metal sheets.

23. The paint spray application system defined in claim 18, wherein said damping layer comprises a polymeric capable of absorbing vibrational energy derived from noise emanating from said scrubber system.

24. The paint spray application system defined in claim 18 further including a floor spaced above said scrubber system inlet and said sound damping reflector is suspended from said floor.

25. The paint spray application system defined in claim 18, wherein said metallic sheet and said sound damping layer have approximately the same thickness.

* * * * *

UNITED STATES PATENT AND TRADEMARK OFFICE

CERTIFICATE OF CORRECTION

PATENT NO. : 6,666,166 B2
DATED : December 23, 2003
INVENTOR(S) : Jason L. Kramer et al.

It is certified that error appears in the above-identified patent and that said Letters Patent is hereby corrected as shown below:

Column 9,
Line 12, insert -- material -- after the word "polymeric."

Signed and Sealed this

Twenty-fourth Day of February, 2004

JON W. DUDAS
*Acting Director of the United States Patent and Trademark Office*